US007559629B2

(12) United States Patent
King

(10) Patent No.: US 7,559,629 B2
(45) Date of Patent: Jul. 14, 2009

(54) METHODS AND APPARATUSES FOR IMPLEMENTING MULTI-VIA HEATER CHIPS

(75) Inventor: David G. King, Shelbyville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/238,559

(22) Filed: Sep. 29, 2005

(65) Prior Publication Data

US 2007/0070126 A1 Mar. 29, 2007

(51) Int. Cl.
*B41J 2/05* (2006.01)
*B41J 2/04* (2006.01)

(52) U.S. Cl. ..... 347/59; 347/54

(58) Field of Classification Search ..... 347/5, 347/59, 62

See application file for complete search history.

(56) References Cited

U.S. PATENT DOCUMENTS

| | | | | |
|---|---|---|---|---|
| 5,594,488 | A | 1/1997 | Tsushima et al. | |
| 5,646,660 | A | 7/1997 | Murray | |
| 5,731,828 | A | 3/1998 | Ishinaga et al. | |
| 5,812,162 | A | 9/1998 | Silverbrook | |
| 6,260,952 | B1 | 7/2001 | Feinn et al. | |
| 6,357,863 | B1 | 3/2002 | Anderson et al. | |
| 6,382,773 | B1 | 5/2002 | Chang et al. | |
| 6,386,674 | B1 | 5/2002 | Corrigan, III et al. | |
| 6,398,347 | B1 | 6/2002 | Torgerson et al. | |
| 6,474,782 | B1 | 11/2002 | Furukawa | |
| 6,488,363 | B2 | 12/2002 | Torgerson et al. | |
| 6,499,834 | B2 * | 12/2002 | Takizawa | 347/57 |
| 6,601,941 | B1 | 8/2003 | Jones et al. | |
| 6,616,259 | B2 * | 9/2003 | Sasayama | 347/15 |
| 6,641,242 | B2 | 11/2003 | Canti et al. | |
| 6,644,774 | B1 | 11/2003 | Burger et al. | |
| 6,663,227 | B2 | 12/2003 | Yamamoto et al. | |
| 6,764,163 | B2 | 7/2004 | Anderson et al. | |
| 6,808,243 | B1 | 10/2004 | Markham et al. | |
| 6,871,929 | B2 | 3/2005 | Crivelli et al. | |
| 6,883,904 | B2 | 4/2005 | Jeanmarie et al. | |
| 6,890,064 | B2 | 5/2005 | Torgerson et al. | |
| 6,951,378 | B1 | 10/2005 | Yamada et al. | |
| 2003/0142159 | A1 | 7/2003 | Askeland et al. | |
| 2005/0052500 | A1 | 3/2005 | Edelen et al. | |

(Continued)

FOREIGN PATENT DOCUMENTS

JP 11-254409 * 9/1999

OTHER PUBLICATIONS

Disclosure Under § 1.56 filed Jul. 29, 2008.

*Primary Examiner*—Manish S Shah
*Assistant Examiner*—Geoffrey Mruk
(74) *Attorney, Agent, or Firm*—Sutherland, Asbill, Brennan LLP

(57) ABSTRACT

A heater chip for use in a printing device that includes a first heater array with a left side and a right side and a first ink via placed on the left side of the first heater array. The chip also includes a second heater array with a left side and a right side, where a right side of the first heater array faces the left side of the second heater array, a second ink via placed on the right side of the second heater array, and at least one logic array is disposed between the first heater array and the second heater array.

14 Claims, 5 Drawing Sheets

U.S. PATENT DOCUMENTS

2005/0162450 A1 7/2005 Sakurai
2005/0185023 A1 8/2005 Furukawa et al.
2007/0153045 A1 7/2007 Barkley et al.

* cited by examiner

METHODS AND APPARATUSES FOR IMPLEMENTING MULTI-VIA HEATER CHIPS

FIELD OF THE INVENTION

The present invention relates generally to printer heads, and more particularly to methods and apparatuses for implementing multi-via heater chips.

BACKGROUND OF THE INVENTION

A number of printers, copiers, and multi-function products utilize heater chips in their printing heads for discharging ink drops from one or more ink vias. These heater chips typically provide only one heater array for each ink via that is disposed along one side of the ink via. In particular, as shown in FIG. 1, a traditional heater chip 100 may include three ink vias—a cyan ink via 102, a magenta ink via 104, and a yellow ink via 106. The cyan ink via 102 operates with the cyan heater array 108; the magenta ink via 104 operates with the magenta heater array 110; and the yellow ink via 106 operates with the yellow heater array 112. However, the traditional use of single heater array on a single side of an ink via limits the achievable printing resolution, including the vertical resolution. The configuration shown in FIG. 1 may have significant difficulty providing ink drop sizes of less than 4 pL (picoliters) while achieving a vertical resolution of about 1200 dpi (dots per inch) or better.

In addition, connections between the logic arrays and the heater arrays they address occupy a significant amount of space on the heater chips. In some instances, these connections may occupy as much space as the heater arrays themselves. As an example, as shown in FIG. 1, lengthy wiring buses 120, 122, and 124 have been utilized to allow communications between each of the P-register logic arrays 114, 116, and 118 and their respective heater arrays 108, 110, and 112. As shown in the configuration of FIG. 1, the wiring buses 120, 122, and 124 occupy significant space on the heater chip 100, thereby increasing the chip size and reducing the die yields per wafer.

Accordingly, there is a need in the industry for heater chips that can provide for enhanced printing resolutions while reducing chip die sizes.

BRIEF SUMMARY OF THE INVENTION

According to an embodiment of the present invention, there is a chip for use in a printing device. The chip includes a first heater array with a left side and a right side, a first ink via placed on the left side of the first heater array, a second heater array with a left side and a right side, where a right side of the first heater array faces the left side of the second heater array, a second ink via placed on the right side of the second heater array, and at least one logic array disposed between the first heater array and the second heater array.

According to an aspect of the present invention, the chip may further include a third heater array and a fourth heater array, where the third heater array and first heater array sandwich the first ink via and the fourth heater array and the second heater array sandwich the second ink via. The first and second ink via may include one of a cyan ink via, a magenta ink via, a yellow ink via, and a monochrome ink via. According to another aspect of the invention, the at least one logic array may include a first logic array for addressing the first heater array and a second logic array for addressing the second heater array, where the first logic array is substantially parallel to the second logic array. Alternatively or in addition, the at least one logic array may include a single logic array having first logic cells for addressing the first heater array and second logic cells for addressing the second heater array, where the single logic array is substantially linear. At least a portion of the first logic cells may be interleaved with at least a portion of the second logic cells, thereby making the single logic array non-contiguous. With such interleaving, a pair of second logic cells may be interleaved between a first pair of first logic cells and a second pair of first logic cells.

According to another embodiment of the invention, there is an integrated multi-via heater chip. The heater chip includes a first heater array having a left side and a right side, a first ink via positioned on the left side of the first heater array, a second heater array having a left side and a right side, where the first heater array and the second heater array are positioned opposite one another so that the right side of the first heater array is facing the left side of the second heater array, a second ink via positioned on the right side of the second heater array, and a first logic array positioned between the first heater array and the second heater array, where the first logic array includes a plurality of first logic cells for addressing the first heater array and a plurality of second logic cells for addressing the second heater array.

According to an aspect of the invention, at least a portion of the first set of logic cells and at least a portion of the second set of logic cells may be substantially aligned. The first logic cells may be interleaved with the second logic cells. According to another aspect of the invention, the heater chip may further include a third heater array positioned on the left side of the first heater array and a fourth heater array positioned on the right side of the second heater array, where the first ink via is positioned between the first heater array and the second heater array and the second ink via is positioned between the third heater array and the fourth heater array. In such an arrangement, the heater chip may further include a second logic array positioned on a left side of the third heater array and a third logic array positioned on a right side of the fourth heater array, where the second logic array includes at least a plurality of third logic cells for addressing the third heater array and the third logic array includes at least a plurality of fourth logic cells for addressing the fourth heater array.

According to yet another aspect of the present invention, at least a portion of control signals for the first logic cells may be routed between the first heater array and the first logic array and at least a portion of control signals for the second logic cells may be routed between the second heater array and the first logic array. The first heater array may include a plurality of blocks of heaters and the second heater array may also include a plurality of blocks of heaters, where each block of heaters in the first heater array is addressed by at least a portion of the first logic cells and where each block of heaters in the second heater array is addressed by at least a portion of the second logic cells.

According to another embodiment of the present invention, there is a method of fabricating chips for use in a printing device. The method includes providing a first heater array and a second heater array for a first ink via, where the first ink via is positioned between the first heater array and second heater array, providing a third heater array and a fourth heater array for a second ink via, where the second ink via is positioned between the third heater array and the second heater array and where a right side of the second heater array faces a left side of the third heater array, and positioning a first logic array between the second heater array and the third heater array, where the first logic array includes a plurality of first logic cells in communication with the second heater array and a plurality of second logic cells in communication with the third heater array.

According to an aspect of the present invention, at least a portion of the first logic cells may be connected in series to each other and at least a portion of the second logic cells may be connected in series to each other. In addition, at least a portion of the first logic cells may be interleaved between at least a portion of the second logic cells, thereby making the first logic array non-contiguous. In such an arrangement, the first and second logic cells may be arranged linearly. According to another aspect of the invention, at least a portion of the first and second logic cells may each include a shift register and a latch at an output of the shift register. According to yet another aspect of the invention, the method may further include positioning a second logic array on a left side of the first heater array and positioning a third logic array on a right side of the fourth heater array, wherein the second logic array includes third logic cells for communicating with the first heater array and wherein the third logic array includes fourth logic cells for communicating with the fourth heater array.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

According to a first aspect of the present invention, heater arrays may be positioned on both sides of at least a portion of the ink vias, which allow the ink vias to provide smaller ink drops in order to achieve higher printing resolutions. Each of these heater arrays may include a plurality of individual heaters fabricated as resistors in the heater chips. For example, these resistors may be thin-film resistors in accordance with an exemplary embodiment of the invention. These thin-film resistors may be formed of a variety of materials, including platinum, gold, silver, copper, aluminum, alloys, and other materials. The heaters may also be formed of other technologies besides thin-film resistors as known to those of ordinary skill in the art. When the heaters in the heater arrays are activated, they provide thermal energy to the ink via, and the ink is discharged.

Figure 1:
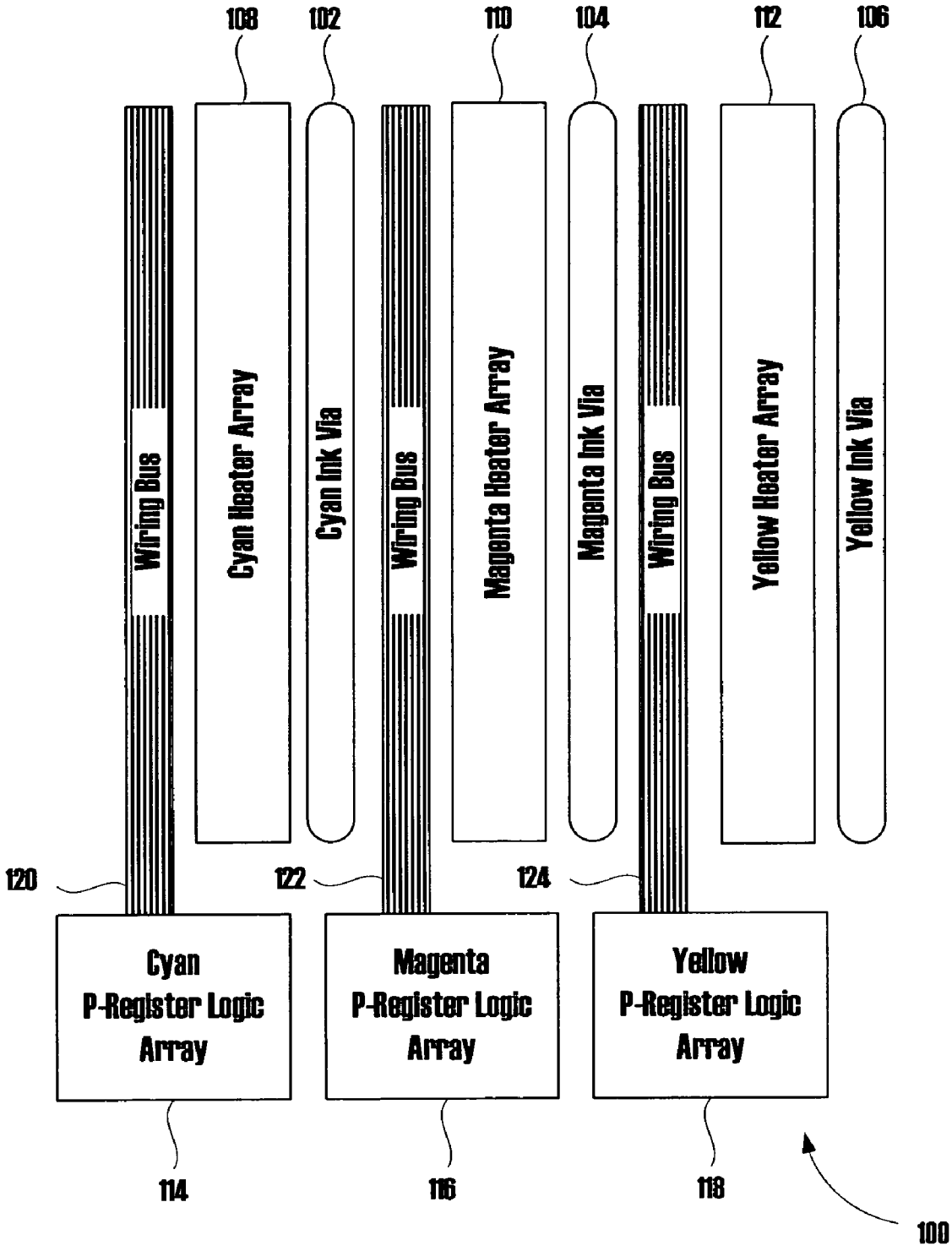
FIG. 1 (Prior Art)
FIG. 1 illustrates a traditional heater chip utilizing wiring buses for connections between the P-register logic arrays and the respective heater arrays.

Moreover, when heater arrays are positioned on both sides of vias in a multi-via heater chip, at least two heater arrays may be adjacent to each other. Thus, according to a second aspect of the present invention, a single, hybrid non-contiguous logic array may be disposed between adjacent heater arrays for addressing the adjacent heater arrays. This configuration reduces the area needed for the logic arrays, thereby allowing for a much smaller die size compared to the use of the wiring buses of FIG. 1. Both the first second aspects of the invention will now be discussed below with reference to FIGS. 2-5.

Figure 2:
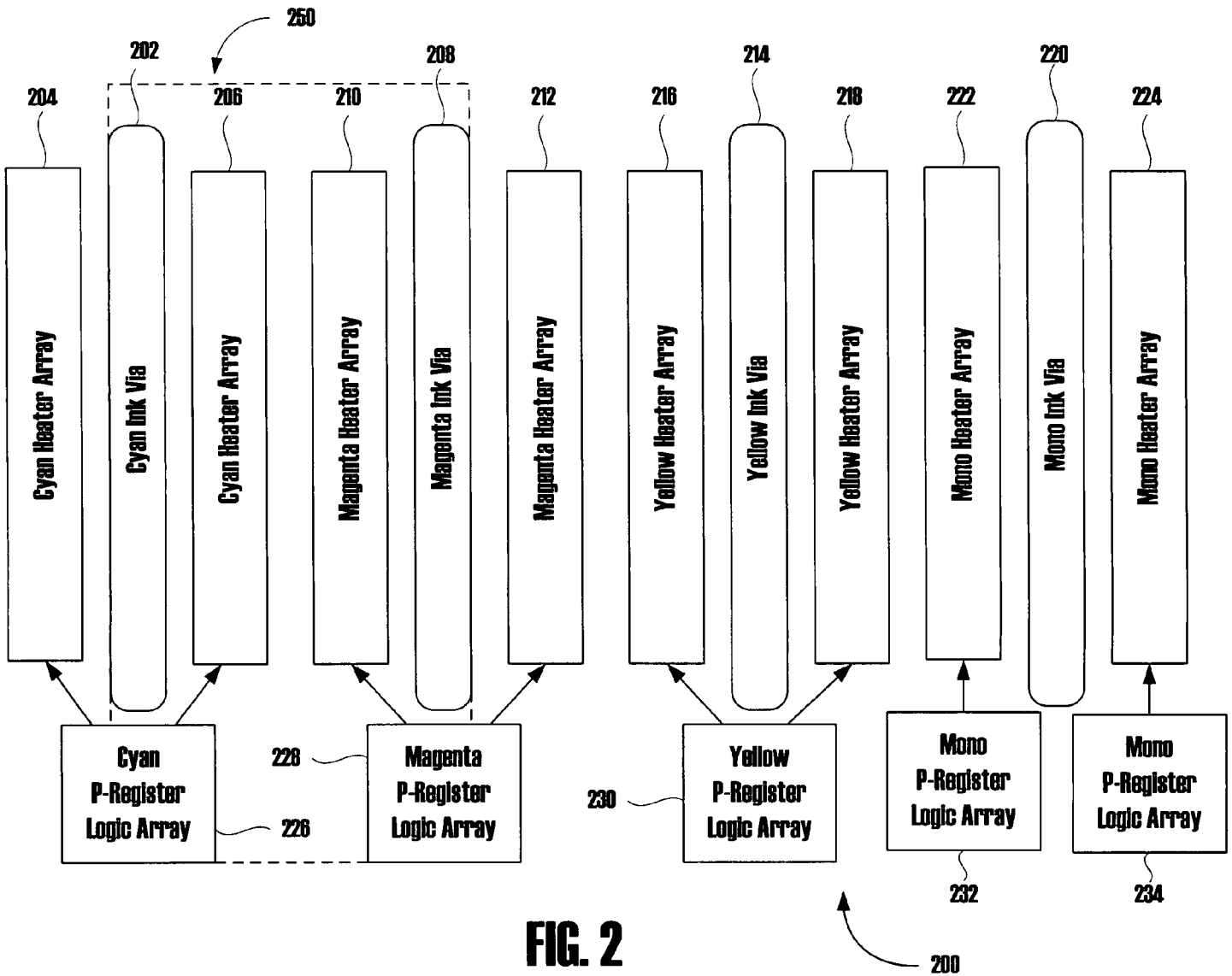
FIG. 2 illustrates ink vias disposed between heater arrays, according to an exemplary embodiment of the present invention.

FIG. 2 illustrates a first aspect of the present invention where a CMYK (cyan-magenta-yellow-monochrome) heater chip 200 includes four ink vias each disposed between two heater arrays. In particular, a cyan ink via 202 is positioned between a first heater array 204 and a second heater array 206; a magenta ink via 208 is positioned between a first heater array 210 and a second heater array 212; a yellow ink via 214 is positioned between a first heater array 216 and a second heater array 218; and a monochrome (K) ink via 220 is positioned between a first heater array 222 and a second heater array 224. One of ordinary skill in the art will also recognize that fewer or more ink vias and corresponding heater arrays may be utilized as necessary. As an example, an additional monochrome (K) ink via may be disposed between two additional heater arrays to form a CMYKK heater chip. In addition, in other embodiments of the invention, perhaps only a portion of the ink vias may be disposed between two heater arrays. For example, the monochrome ink via 220 may alternatively include only one monochrome heater array along a single side of the monochrome ink via 220.

The heater arrays 204, 206, 210, 212, 216, 218, 222, and 224 illustrated in FIG. 2 may each contain a plurality of heaters. In an exemplary embodiment of the invention, a least a portion of the plurality of heaters within each heater array may be serially connected. One of ordinary skill in the art will also recognize that parallel connections may also be made with the heaters, depending on the desired routing characteristics of the heater arrays. In certain illustrative embodiments of the present invention, the heater arrays 204, 206, 210, 212, 216, 218, 222, and 224 may include an array of 320 heaters each, although more or less heaters may be utilized in the heater arrays as necessary according to alternative embodiments of the present invention. These 320 heaters may be grouped and addressed in blocks of 20 or 40 heaters each, although alternative groupings with varying numbers of heaters may also be utilized. In other embodiments, each of the heater arrays 204, 206, 210, 212, 216, 218, 222, and 224 may have varying numbers of heaters grouped in varying blocks. Many other variations are readily apparent to one of ordinary skill in the art.

Still referring to FIG. 2, each of the heater arrays 204, 206, 210, 212, 216, 218, 222, and 224 may be addressed and controlled, at least in part, by logic arrays, which may be P-register logic arrays in accordance with an exemplary embodiment of the present invention. Each of these P-register logic arrays may be 32 bits in certain embodiments of the present invention, although more or less bits may utilized as necessary. In FIG. 2, a cyan P-register logic array 226 may address both the first heater array 204 and the second heater array 206; a magenta P-register logic array 228 may address the first heater array 210 and the second heater array 212; a yellow P-register logic array 230 may address the first heater array 216 and the second heater array 218; a first monochrome P-register logic array 232 may address the first monochrome heater array 222; and a second monochrome P-register logic array 234 may addresses the second monochrome heater array 224.

According to an exemplary embodiment of the present invention, each group of two bits (known as a "primitive group") in each of the cyan P-register 226, magenta P-register 228, and yellow P-register 230 logic arrays may address a block of heaters, perhaps 40 heaters, in the respective heater arrays 204, 206, 210, 212, 216, and 218. In certain embodiments where each P-register logic array 226, 228, and 230 includes 32-bits, this allows sixteen primitive groups within each P-register logic array 226, 228, and 230 to address up to a total of sixteen blocks of 40 heaters or a total of 640 heaters. Where each heater array includes 320 heaters, this allows each of the P-register logic arrays 226, 228, and 230 to address the two heater arrays surrounding their respective ink vias. One of ordinary skill in the art will recognize that the number of bits needed for the P-register logic arrays may depend at least in part on the size of the heater arrays and the groupings and addressing schemes for the heaters within the heater arrays. One of ordinary skill in the art will also recognize that the size of each primitive group may be more or less than two bits as necessary. For example, a primitive group may be four bits.

Like the P-register logic arrays 226, 228, and 230 discussed above, each group of two bits (also known as a "primitive group") in the first and second monochrome P-register logic arrays 232 and 234, may address a block of heaters, perhaps 20 heaters, in the respective monochrome heater arrays 222 and 224. One of ordinary skill in the art will recognize that the number of bits required to address the blocks of heaters in a heater array may be vary without departing from embodiments of the present invention. For example, if the monochrome heater arrays 222 and 224 having 320 heaters each were addressed in blocks of 40 using two bit primitive groups, then the first and second P-register logic arrays 232 and 234 could be combined into a single 32-bit P-register logic array capable of addressing 640 heaters. Many other addressing variations will be readily apparent to one of ordinary skill in the art.

Figure 3:
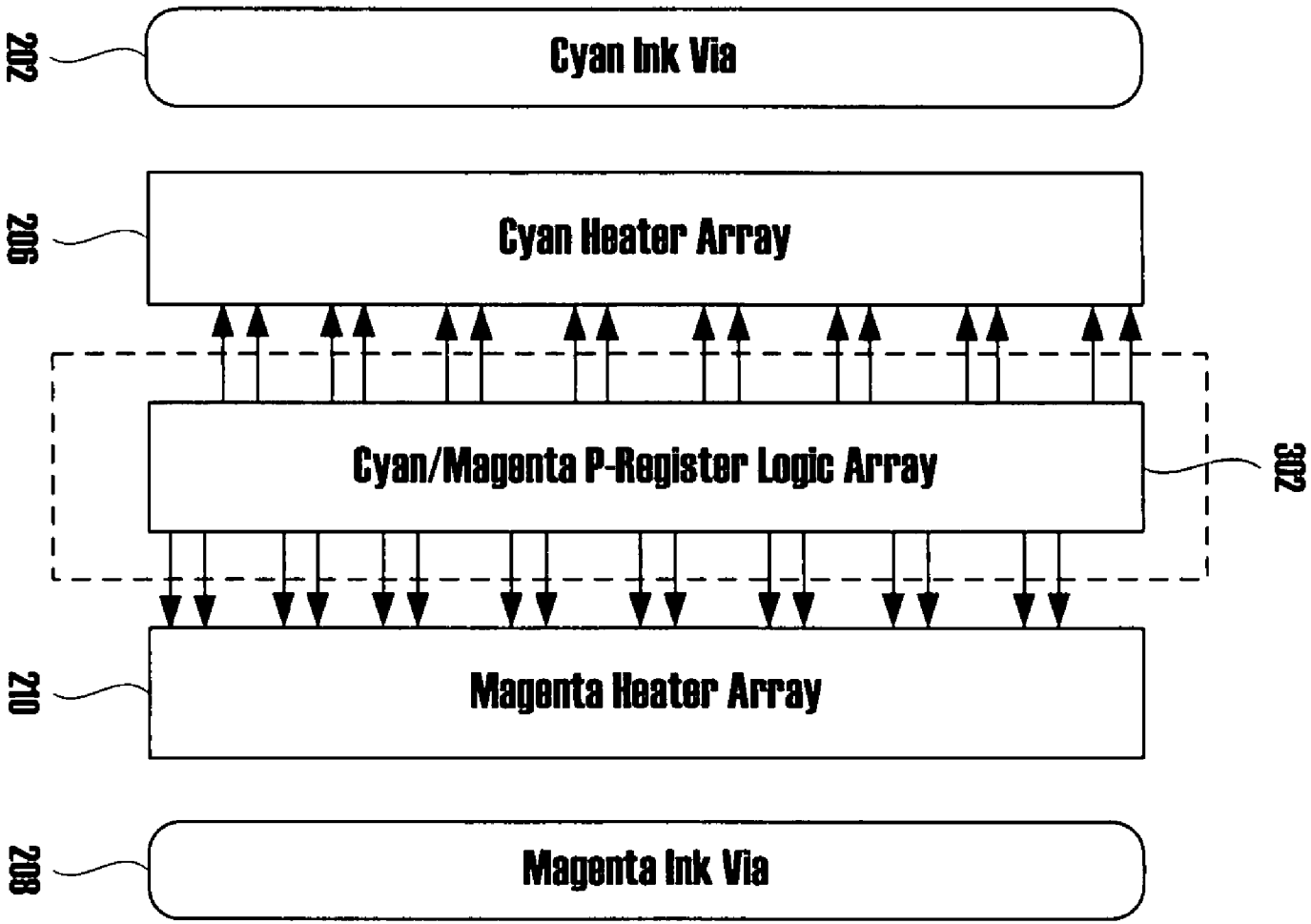
FIG. 3 illustrates an exemplary configuration for a single hybrid, non-contiguous P-register logic array between two heater arrays, according to an embodiment of the present invention.

In accordance with a second aspect of the present invention, at least a portion of two different P-register logic arrays shown in FIG. 2 may be combined to form a single hybrid, non-contiguous P-register logic array to reduce the size of the heater chip. FIG. 3 illustrates such an exemplary embodiment where the area 250 of FIG. 2 may be configured to interleave a portion of the cyan P-register logic array 226 with a portion of the magenta P-register logic array 228 to form a single hybrid cyan/magenta P-register logic array 302 positioned between the second cyan heater array 206 and the first magenta heater array 210. According to an exemplary embodiment, the hybrid cyan/magenta P-register logic array 302 may include logic cells providing at total of 32 bits—16 bits for addressing eight groups of 40 heaters (a total of 320 heaters) in the second cyan heater array 206 and 16 bits for addressing eight groups of 40 heaters (a total of 320 heaters) in the first magenta heater array 210.

Figure 4:
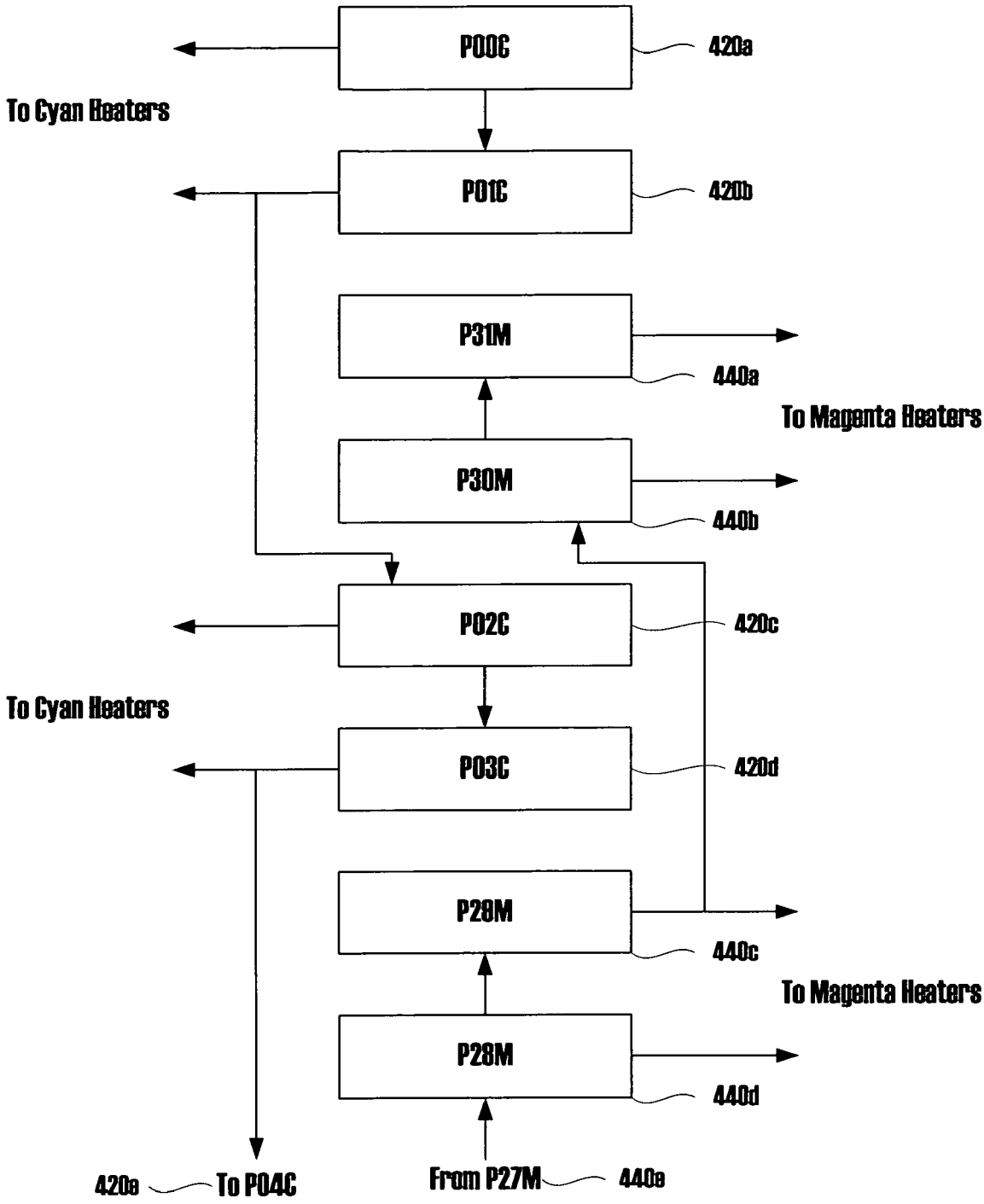
FIG. 4 illustrates an exemplary configuration for logic cells for the single hybrid, non-contiguous P-register logic array of FIG. 3, according to an embodiment of the present invention.

FIG. 4 shows a configuration of the logic cells for the hybrid cyan/magenta P-register logic array 302 of FIG. 3 according to an exemplary embodiment of the present invention. In particular, FIG. 4 illustrates a plurality of cyan logic cells 420*a-n* interleaved with the magenta logic cells 440*a-n* in such a way as to minimize the space necessary between the second cyan heater array 206 and the first magenta heater array 210. According to an embodiment of the present invention, the magenta logic cells 440*a-n* may be interleaved between the cyan logic cells 420*a-n* in an alternating manner to form a single, linear hybrid cyan/magenta P-logic array 302. According to an exemplary embodiment, a pair of magenta logic cells 440*a-n* may be interleaved between each pair of cyan logic cells 420*a-n* as shown in FIG. 4B. As indicated above, each pair in logic cells 420*a-n* or 440*a-n* (e.g., a primitive group) may address a block of 40 heaters in the respective heater rays 206 and 210, respectively, according to an exemplary embodiment. Because of this interlacing of cyan P-registers 420*a-n* and magenta P-registers 440*a-n*, neither the cyan P-registers 420*a-n* nor the magenta P-registers 440*a-n* remain contiguous. For example, in FIG. 4, the cyan logic cell 420*b* is followed by the magenta logic cell 440*a* instead of the next cyan logic cell 420*c*. One of ordinary skill in the art will immediately recognize that other configurations other than that shown in FIG. 4 are possible. For example, groups of 3 or 4 magenta P-registers 440*a-n* may be interlaced between groups of 2, 3, or 4 cyan P-registers 420*a-n*. Numerous variations will be readily apparent to one of ordinary skill in the art.

The logic cells 420*a-n* and 440*a-n* in FIG. 4 may include or operate as serial shift registers with parallel hold latches on the output of the serial shift registers. As serial shift registers, each stage typically feeds a next stage in a serial manner similar to how logic cell 420*a* feeds into logic cell 420*b* which feeds into logic cell 420*c* and the like in FIG. 4. Each logic cell 420*a-n* and 440*a-n* may also receive input in the form of a PDATA, a CLOCK signal, and a LOAD signal. The PDATA signal may provide on/off data for the heaters in the heater arrays. During the cycle of the CLOCK signal, the PDATA may be loaded into the shift registers of the logic cells. In other words, the CLOCK signal may specify the PDATA that is stored in each logic cell.

Once the PDATA has been stored as values in the logic cells 420*a-n* and 440*a-n*, these stored values are maintained at the output of the logic cells by a LOAD signal activating the parallel hold latches at the output of the logic cells 420*a-n* and 440*a-n*. This stored values maintained at the output of the P-registers may, in conjunction with one or more FIRE signals, allow the logic cells 420*a-n* and 440*a-n* to activate and deactivate the heaters within the respective heater arrays 206 and 210. In accordance with an embodiment of the invention, the logic cells 420*a-n* may utilize a different PDATA, CLOCK, LOAD, and FIRE signals than the logic cells 440*a-n*. One of ordinary skill in the art will recognize that other signals may be utilized with the logic cells 420*a-n* and 440*a-n* and heater arrays as necessary or desired.

In accordance with an exemplary embodiment of the present invention, the control signals for cyan logic cells 420*a-n*, which may include one or more of its PDATA, CLOCK, LOAD, and FIRE signals, may be routed between the cyan heater array 206 and the cyan/magenta P-register logic array 302 in FIG. 3. Likewise, the control signals for magenta logic cells 440*a-n*, which include one or more of its PDATA, CLOCK, LOAD, and FIRE signals, may be routed between the magenta heater array 210 and the cyan/magenta P-register logic array 302 in FIG. 3. This may reduce the possibility of crosstalk or interference between respective PDATA, CLOCK, LOAD, and/or FIRE signals.

Figure 5:
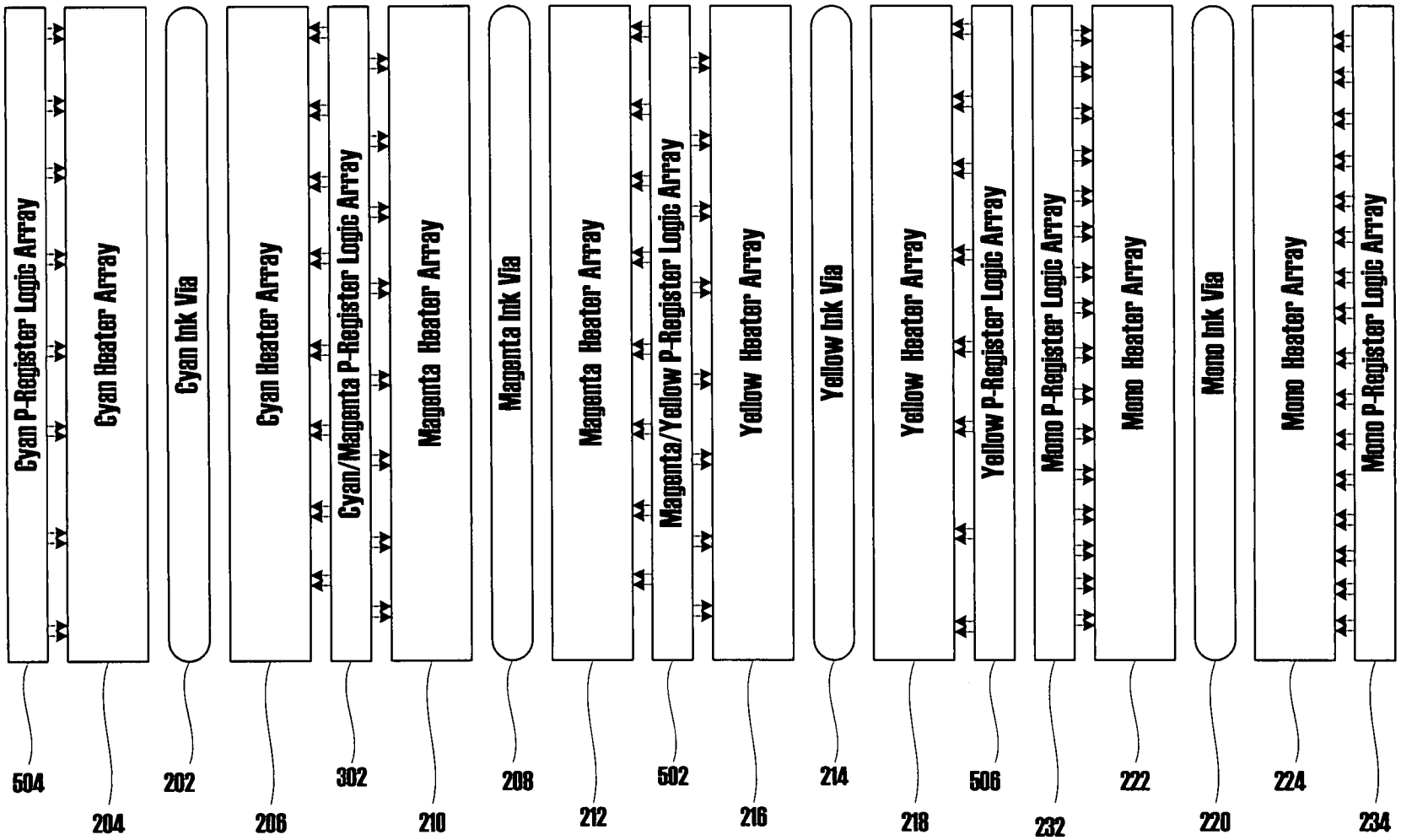
FIG. 5 illustrates an exemplary configuration for a heater chip in accordance with an embodiment of the present invention.

FIG. 5 illustrates an exemplary configuration that extends the interleaved configuration of logic cells described in FIG. 4 to the magenta P-register logic array 228 and yellow P-register logic array 230 shown in FIG. 2. In particular, FIG. 5 illustrates that at least a portion of the P-register logic array 228 and yellow P-register logic array 230 may be combined into a single hybrid magenta/yellow P-register logic array 502. According to an exemplary embodiment, the single hybrid magenta/yellow P-register logic array 502 may include logic cells providing at total of 32 bits—16 bits for addressing eight groups of 40 heaters (a total of 320 heaters) in the second magenta heater array 212 and 16 bits for addressing eight groups of 40 heaters (a total of 320 heaters) in the first yellow heater array 216.

In the exemplary embodiment of FIG. 5, the logic cells of the cyan P-register logic array 504 are in communication with the cyan logic cells 420*a-n* of the cyan/magenta P-register logic array 302 and together form the cyan-P register 226 shown in FIG. 2. Similarly, the magenta logic cells 440*a-n* in the cyan/magenta P-register logic array 302 are in communication with to the magenta logic cells in the magenta/yellow P-register logic array 502 and together form the magenta P-register logic array 228 shown in FIG. 2. Likewise, the yellow logic cells of the magenta/yellow P-register logic array 502 are in communication with the yellow P-register logic array 506 and together form the yellow P-register logic array 230 shown in FIG. 2.

According to an exemplary embodiment of the present invention, the cyan P-register logic array 504 may include logic cells with 16 bits for addressing eight groups of 40 heaters (a total of 320 heaters) in the first cyan heater array 204. The cyan/magenta P-register logic array 302 may include logic cells with 32 bits—16 of which address eight groups of 40 heaters in the second cyan heater array 206 and 16 of which address eight groups of 40 heaters in the first magenta heater array 210. Similarly, magenta/yellow P-register logic array 502 may include logic cells with 32 bits-16 of which address eight groups of 40 heaters in the second magenta heater array 212 and 16 of which address eight groups of 40 heaters in the first yellow heater array 216. The yellow P-register logic array 506 may include logic cells with 16 bits for addressing eight groups of 40 heaters in the second yellow heater array 218. According to an exemplary embodiment of the invention, the first monochrome P-register logic array 232 may include logic cells with 32-bits for addressing 16 groups of 20 heaters in the first monochrome heater array 222. Similarly, the second monochrome P-register logic array 234 may include logic cells with 32-bits for addressing 16 groups of 20 heaters in the second monochrome heater array 224. One of ordinary skill will recognize that in other embodiments, 16-bits may be utilized to instead address 8 groups of 40 heaters in the first and second monochrome P-register logic arrays 232 and 234. One of ordinary skill will also recognize that in other embodiments, the yellow P-register logic array 506 and the first monochrome P-register logic array 232 may be combined, like the configuration shown in FIG. 4 or variants thereof, to form a single hybrid yellow/monochrome logic array.

While the primitive groups (e.g., groupings of 2 bits) in the P-register logic arrays disclosed in FIG. 5 have only addressed blocks of heaters in a single heater array, one of ordinary skill in the art will readily recognize that these P-register logic arrays may, in alternative embodiments, address blocks of heaters from more than one heater array. For example, each cyan primitive group in the cyan/magenta P-register logic array 302 may address a block of heaters, perhaps 40 heaters, in both the first heater array 204 and the second heater array 206. In such an alternative embodiment, the cyan/magenta P-register logic array 302 may entirely replace the cyan P-register logic array 504, thus further reducing the size of the heater chip. Many other variations will be readily apparent to one of ordinary skill in the art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A chip for use in a printing device, comprising:

a first heater array with a left side and a right side;

a first ink via placed on the left side of the first heater array;

a second heater array with a left side and a right side, wherein a right side of the first heater array faces the left side of the second heater array;

a second ink via placed on the right side of the second heater array; and at least one logic array including a first and a second set of logic cells arranged in a non-contiguous hybrid arrangement, the at least one logic array is disposed substantially between the first heater array and the second heater array, wherein the first set of logic cells addresses and controls the first heater array and the second set of logic cells addresses and controls the second heater array, which allows the first ink via and second ink via to be simultaneously controlled by the at least one logic array, and wherein the at least on logic array is substantially parallel with the first heater array and second heater array.

2. The chip of claim 1, further comprising a third heater array and a fourth heater array, wherein the third heater array and first heater array sandwich the first ink via and the fourth heater array and the second heater array sandwich the second ink via.

3. The chip of claim 1, wherein the first and second ink via comprise one of a cyan ink via, a magenta ink via, a yellow ink via, and monochrome ink via.

4. The chip of claim 1, wherein the at least one logic array includes a first logic array for addressing the first heater array and a second logic array for addressing the second heater array, wherein the first logic array is substantially parallel to the second logic array.

5. The chip of claim 1, wherein the at least one logic array comprises a single logic array having first logic cells for addressing the first heater array and second logic cells for addressing the second heater array, wherein the single logic array is substantially linear.

6. The chip of claim 5, wherein at least a portion of the first logic cells are interleaved with at least a portion of the second logic cells, thereby making the single logic array non-contiguous

7. The heater chip claim 6, wherein a pair of second logic cells is interleaved between a first pair of first logic cells and a second pair of first logic cells.

8. An integrated multi-via heater chip, comprising;

a first heater array having a left side and a right side;

a first ink via positioned on the left side of the first heater array;

a second heater array having a left side and a right side, wherein the first heater array and the second heater array are positioned opposite one another so that the right side of the first heater array is facing the left side of the second heater array;

a second ink via positioned on the right side of the second heater array;, and a first logic array positioned substantially between the first heater array and the second heater array, wherein the first logic array includes a plurality of first logic cells for addressing and controlling the first heater array and a plurality of second logic cells for addressing and controlling the second heater array, the plurality of first logic cells and the plurality of second logic cells are arranged in a non-contiguous hybrid arrangement which allows the first ink via and second ink via to be simultaneously controlled by the first logic array, and wherein the first logic array is substantially parallel with the first heater array and second heater array.

9. The heater chip of claim 8, wherein at least a portion of the first set of logic cells and at least a portion of the second set of logic cells are substantially aligned.

10. The heater clip of claim 8, wherein the first logic cells are interleaved with the second logic cells.

11. The heater chip claim 8, further comprising a third heater array positioned on the left side of the first heater array and a fourth heater array positioned on the right side of the second heater array, wherein the first ink via is positioned between the first heater array and the second heater array and the second ink via is positioned between the third heater array and the fourth heater array.

12. The heater chip of claim 11, further comprising a second logic array positioned on a left side of the third heater array and a third logic array positioned on a right side of the fourth heater array, wherein the second logic array includes at least a plurality of third logic cells for addressing the third heater array and the third logic array includes at least a plurality of fourth logic cells for addressing the fourth heater array.

13. The heater chip claim 8, wherein at least a portion of control signals for the first logic cells are routed between the first heater array and the first logic array and wherein at least a portion of control signals for the second logic cells are routed between the second heater array and the first logic array.

14. The heater chip of claim 8, wherein the first heater array comprises a plurality of blocks of heaters and the second heater array comprises a plurality of blocks of heaters, wherein each block of heaters in the first heater array is addressed by at least a portion of the first logic cells and wherein each block of heaters in the second heater array is addressed by at least a portion of the second logic cells.

* * * * *